US010857071B1

(12) United States Patent
McClure

(10) Patent No.: US 10,857,071 B1
(45) Date of Patent: Dec. 8, 2020

(54) SPITTOON WITH SEALING LID

(71) Applicant: Tim McClure, Brentwood, TN (US)

(72) Inventor: Tim McClure, Brentwood, TN (US)

( * ) Notice: Subject to any disclaimer, the term of this patent is extended or adjusted under 35 U.S.C. 154(b) by 0 days.

(21) Appl. No.: 16/897,656

(22) Filed: Jun. 10, 2020

Related U.S. Application Data

(60) Provisional application No. 63/020,066, filed on May 5, 2020.

(51) Int. Cl.
*A61J 19/00* (2006.01)
*B65D 47/40* (2006.01)

(52) U.S. Cl.
CPC ..... *A61J 19/00* (2013.01); *B65D 47/40* (2013.01); *B65D 2251/20* (2013.01)

(58) Field of Classification Search
CPC ..... A61J 19/00
USPC ..... 4/258
See application file for complete search history.

(56) References Cited

U.S. PATENT DOCUMENTS 743,226 A * 11/1903 Beyer et al. ..... A61J 19/00 4/259
829,687 A * 8/1906 Bean ..... A61J 19/00 4/259
4,858,250 A * 8/1989 Lee ..... A61J 19/00 4/258
4,885,809 A * 12/1989 Muchmore ..... A61J 19/02 4/259
4,908,882 A * 3/1990 Williams ..... A61J 19/00 4/261
5,832,543 A * 11/1998 Bosserman ..... A61J 19/00 4/259
5,927,533 A * 7/1999 Payne ..... B65D 23/102 215/375
D420,776 S * 2/2000 Lynch ..... D34/2
6,507,957 B1 * 1/2003 Ingram ..... A61J 19/00 4/259
6,665,887 B2 * 12/2003 Nguyen ..... A61J 19/02 4/258
6,718,563 B1 * 4/2004 Kreiensieck ..... A61J 19/00 4/258
D691,767 S * 10/2013 Mills ..... D27/187
D730,607 S * 5/2015 Compton ..... D34/2
D731,730 S * 6/2015 Wattenbarger ..... D34/2
D731,731 S * 6/2015 Wattenbarger ..... D34/2
9,522,766 B2 * 12/2016 Bechtold ..... B65D 81/264
10,052,265 B1 * 8/2018 Duffer ..... A61L 2/23
10,632,048 B2 * 4/2020 Nesmith ..... A61J 19/00
2002/0020008 A1 * 2/2002 Nguyen ..... A61J 19/02 4/258
2006/0101564 A1 * 5/2006 Powdermaker ..... A61J 19/00 4/259
2008/0295235 A1 * 12/2008 Taras ..... A61J 19/00 4/271
2016/0184187 A1 * 6/2016 Brown ..... A61J 19/00 4/267

* cited by examiner

*Primary Examiner* — Lori L Baker
(74) *Attorney, Agent, or Firm* — Stephen J. Stark; Miller & Martin PLLC

(57) ABSTRACT

A portable spittoon may be a single use item which has a pivoting closed lid for at least some embodiments. Some embodiments may have internal structure(s) to resist spilling and/or emptying the contents while accepting new fluid/material therein until satisfactorily full. Opposing arms may connect to a lid which pivots about a pivot axis through pivots connected to the arms.

20 Claims, 13 Drawing Sheets

SPITTOON WITH SEALING LID

CLAIM OF PRIORITY

This application claims the benefit of U.S. Provisional Patent Application No. 63/020,066 filed May 5, 2020, which is incorporated herein by reference in its entirety.

FIELD OF THE INVENTION

The present invention relates to a portable and/or disposable spittoon provided with a connected and sealing lid.

BACKGROUND OF THE INVENTION

Utilization of dip, snuff and/or chewing tobacco creates an issue regarding unsanitary and unsightly spitting of saliva and/or tobacco mixture. Spitting on the ground is an unacceptable practice in many situations.

There are several spittoon products on the market that are inconvenient to carry and use. The current products typically require cleaning of the spittoon after use which is an undesirable task. Some users use empty cans or soft drink bottles as spittoons which can be somewhat unsightly to some people.

A need exists for a spittoon that is convenient to use, visually appealing, sealable, easy to carry, and/or disposable could resolve the issue of containing the spit while using tobacco products.

SUMMARY OF THE INVENTION

It is an object of many embodiments of the present invention to provide an improved spittoon.

It is another object of many embodiments of the present invention to provide an improved spittoon having an integral sealing lid.

It is another object of many embodiments of the present invention to provide an improved spittoon construction.

Accordingly, in accordance with many embodiments of the present invention, a spittoon of the presently preferred embodiment has an easily opening and closing, sealing lid. The lid can selectively seal and open access to a port at the top of the container internal to a mouthpiece. The spittoon may preferably be designed for convenient carrying and may be visually appealing. While using dip or other mouth-based tobacco products, the spittoon lid can be pivoted open and the mouth placed at least internally to the mouthpiece and over an inlet port of the spittoon container. Saliva and/or other mouth-based tobacco product mixture can be transferred from the both into the spittoon container through the open port at the top of the bottle internal to the mouthpiece. After transferring the saliva and/or tobacco mixture into the bottle or container, the sealing lid may be pivoted or otherwise closed, sealing contents inside the container. Once the spittoon has been filled sufficiently, the spittoon can be discarded. In fact, an internal member and/or baffles may be utilized to at least resist spilling, if not make emptying very challenging.

Some embodiments of the spittoon may have a clip, such as an integrated clip, to allow carrying the unit attached to a pocket, belt, etc. The embodiments may allow for convenient carrying, possibly of larger units with more capacity.

Some embodiments may have a holster that is designed specifically for the spittoon. The holster could be provided and attached to a belt or other convenient location. The spittoon could be retained in the holster when not in use.

Some embodiments of the spittoon may have a sight window that may permit a user to see how full the unit is.

BRIEF DESCRIPTION OF THE DRAWINGS

The accompanying drawings illustrate the preferred embodiments of the invention and, together with the description, serve to explain the invention. These drawings are offered by way of illustration and not by way of limitation.

DETAILED DESCRIPTION OF THE PREFERRED EMBODIMENT

Figure 1:
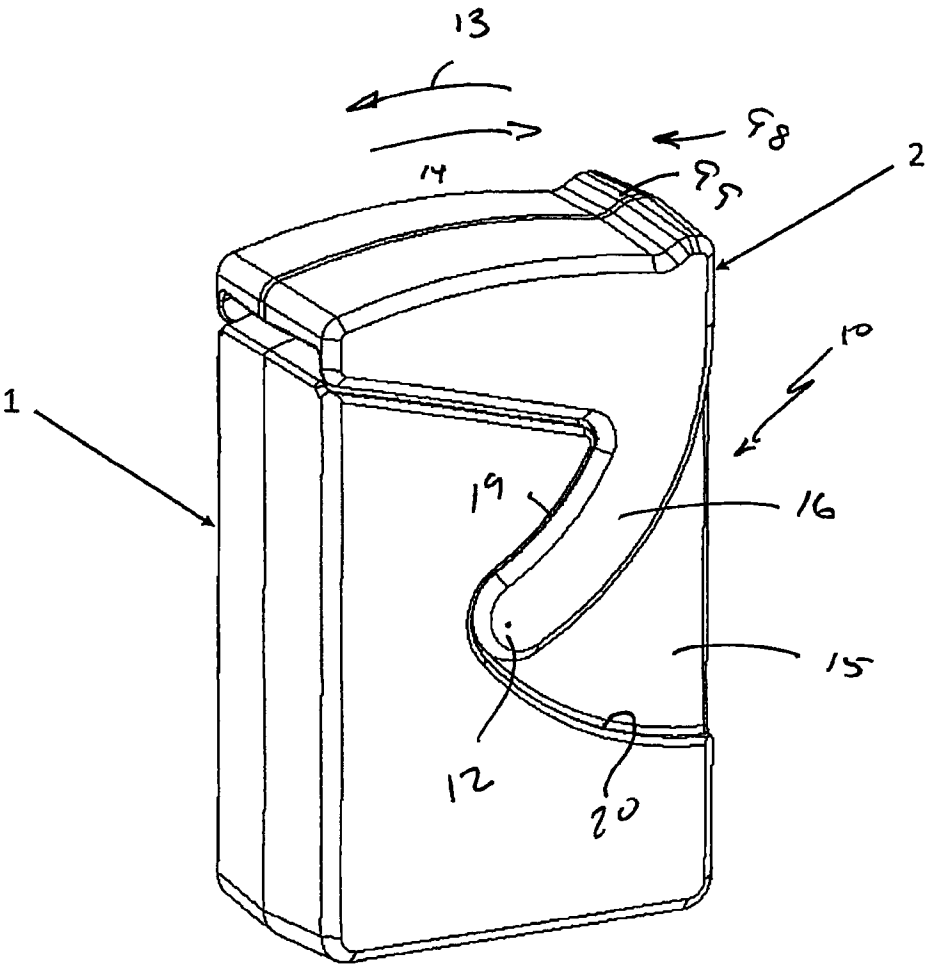
FIG. 1 shows a perspective view of a spittoon container of a presently preferred embodiment of the present invention in an enclosed configuration.
Figure 2:
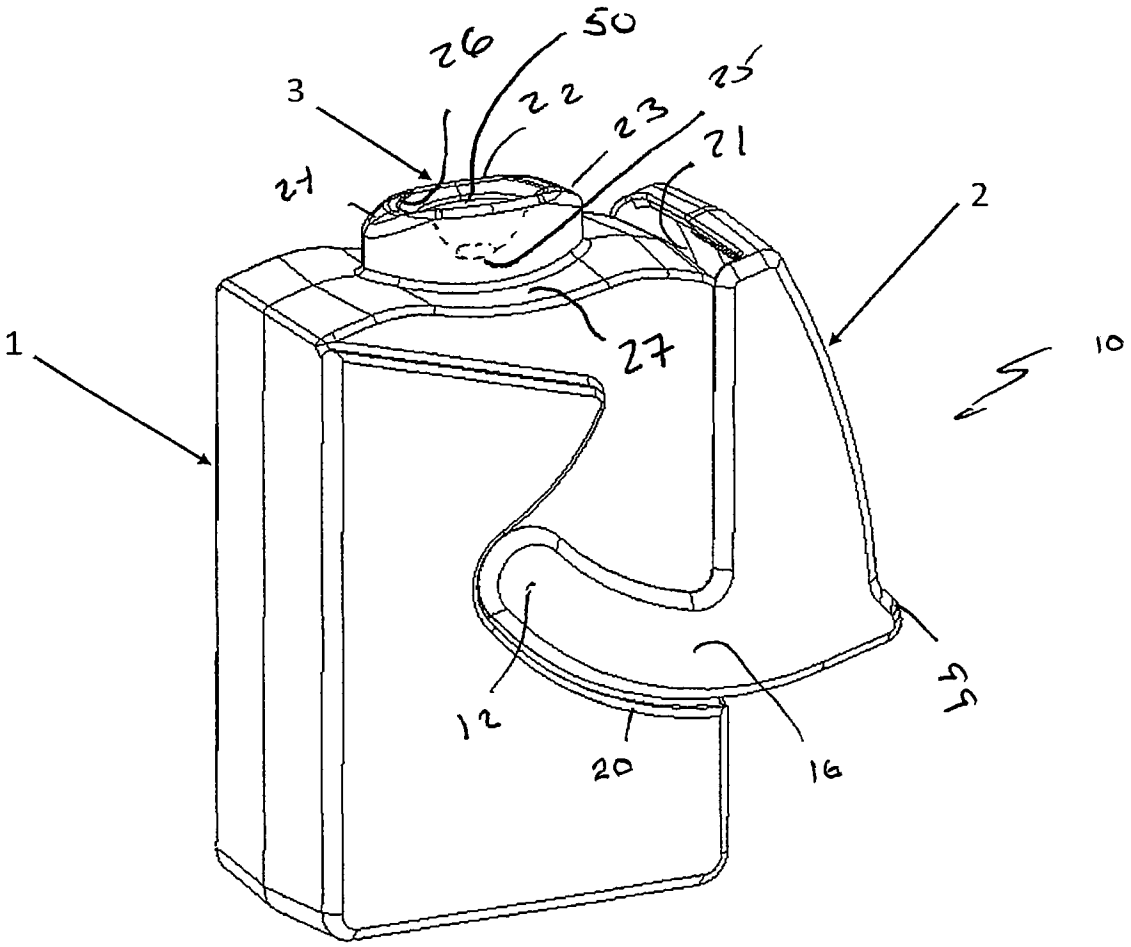
FIG. 2 illustrates a front perspective view of the spittoon container of FIG. 1 in an open configuration.

FIG. 1-2 is a disposable spittoon 10 having a container 1 and a sealing lid 2. The sealing lid 2 may be easily opened and closed to allow depositing of tobacco and/or saliva waste through the mouthpiece 3 into the container 1. When the container 1 is filled sufficiently, the spittoon 10 can be discarded.

Figure 6:
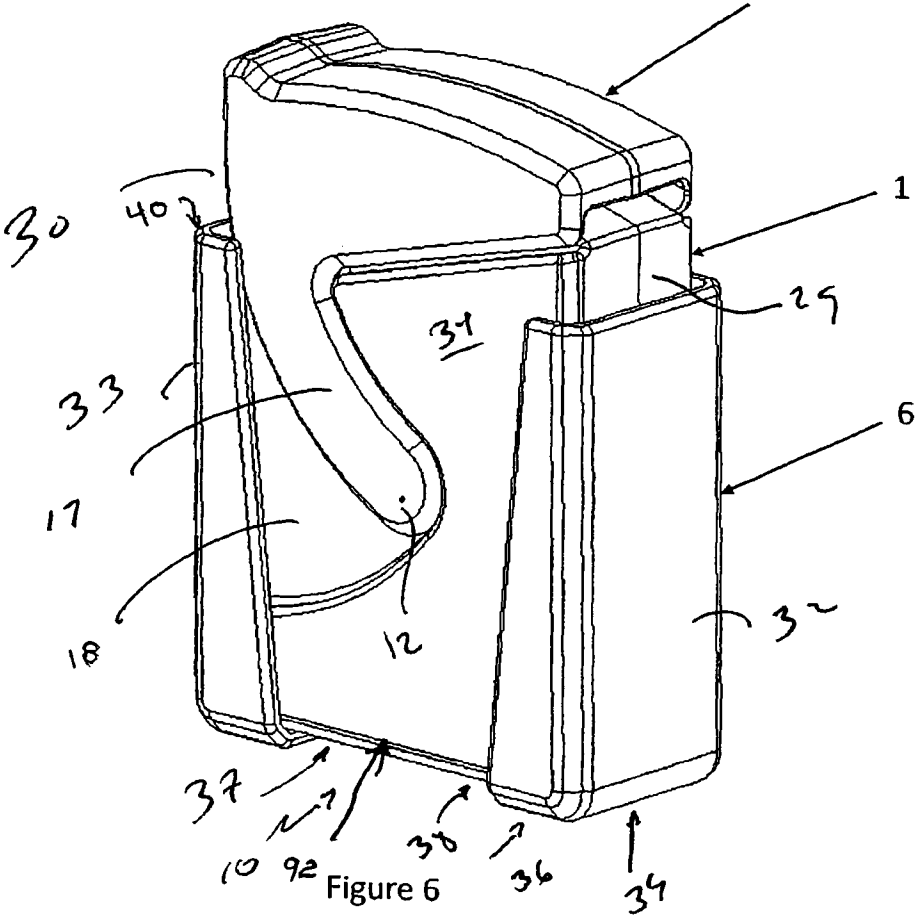
FIG. 6 illustrates a front perspective view of the embodiment of FIG. 5 inserted into the holster.

The spittoon 10 may have a sealing lid 2 that has a pivot 12 whereby rotational direction 13 can close the lid as shown in FIG. 1 to a closed configuration or rotational direction 14 (i.e., which is a pivoting motion) can open the lid 2 as shown in FIG. 2, possibly with one hand to an open configuration. The container 1 may have a cutout 15 to cooperate with the desired range of motion of opposing arms 16, 17 (as shown in FIG. 6) operably coupled to lid 2, such as connected to lid 2 and extend downwardly relative thereto, through a pivot axis along pivot(s) 12 as would be understood from FIGS. 1 and 6 when arms 16, 17 are similarly constructed as shown. Cutout 15 can be complimented by cutout 18 as shown in FIG. 6.

FIG. 2 shows an arm 16 against a first stop, i.e., upper edge 19 of cutouts 15, 18, in a closed configuration preventing further rotation and FIG. 2 shows arm 16 against a second stop, i.e., bottom edge 20 of cutouts 15, 18 in a fully opened configuration preventing further rotation thereby permitting one to selectively utilize the mouthpiece 3 (and then seal mouthpiece 3 shut) as will be explained in detail below. Arm 17 may be similarly restrained, or not.

As shown in FIGS. 1, 3-6 and 8, the sealing lid 2 of the spittoon 10 and 100 is in a closed configuration. Sealing lid 2 preferably performs the task of sealing the lid 2 against the mouthpiece 3 of container 1 to at least resist if not prevent fluid from inadvertently coming out of the enclosed volume or of the container 1 (aka spilling). As can be seen in reference back and forth between FIGS. 1 and 2, transitioning between the closed configuration in FIG. 1 to the open configuration shown in FIG. 2 for the spittoon 10 could be accomplished with one hand for at least some embodiments.

Figure 9:
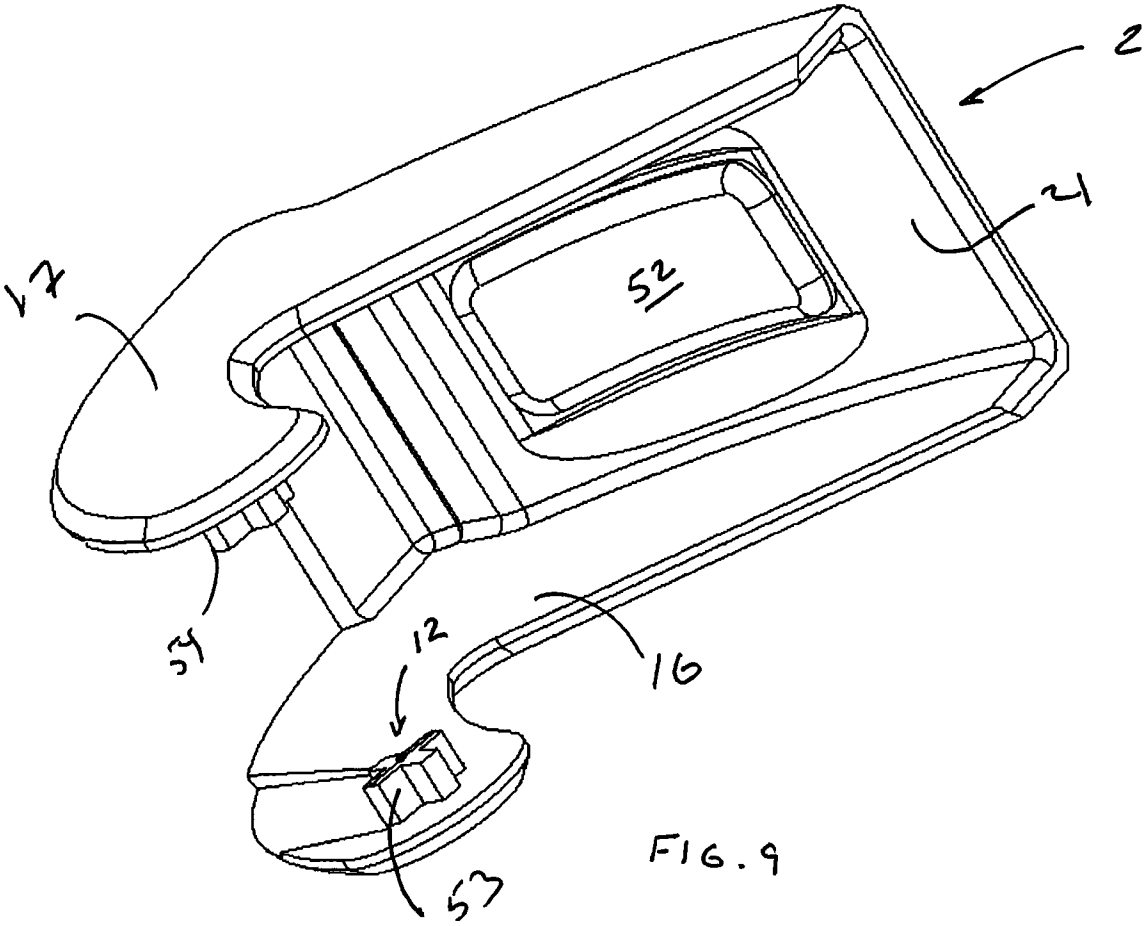
FIG. 9 is a bottom perspective view of the lid shown in FIGS. 1-6.

The sealing lid 2, which at least assists in providing a seal with mouthpiece 3, may have an underside or lower surface portion 21 which may be planar and/or have a coating or resilient seal 52 (see FIG. 9) thereon whereby the lower surface portion 21 could contact and/or potentially deform against mouthpiece 3 and/or assist in the forming of the mouthpiece 3 and/or at least providing a satisfactory seal against upper surface 22 of mouthpiece 3, possibly utilizing ramps 23, 24 to assist in slightly deforming to provide a seal possibly along with upper surface 22. Mouthpiece 3 is located intermediate arms 16, 17 in the closed configuration. Various embodiments of seals and/or lids 2 can be provided. Specifically, the underside, or lower surface portion 21, could have a co-injection molded or adhesively applied (or otherwise applied) seal 52 on the bottom of lid 2 for sealing and/or a seal could be provided with a hard or rigid portion of the lower surface portion 21 depending on the construction of the mouthpiece 3 which could be deformed at least slightly with downward force applied by the lid 2 when in a closed configuration. Pivot 12 is shown formed at least partially with extensions 53, 54 which may be received in bores 55 and the opposite bore could be on the opposing side of half 56 as opposed to half 57 (obscured from view) which could be one way of manufacturing the container 10. Lower surface portion 21 preferably exerts a downward force on seal 52 against mouthpiece 3 in many embodiments. Extension 53, 54 may extend perpendicularly to arms 16, 17 for many embodiments.

Internal mouthpiece 3 at an upper portion of container 10 preferably provides a port 25 which could be a funnel like structure for at least some embodiments possibly beginning with a larger perimeter and then narrowing intermediate an upper surface or upper edge 22 and narrowing towards port 25 through which a user can direct saliva by preferably placing their lips against mouthpiece 3 such as preferably internal, possibly completely internal, to perimeter 26 which may circumnavigate the port 25 with the perimeter 26 possibly extending around upper edge 22 in the illustrated embodiment which circumnavigates port 25 and is at least partially internally to ramps 23, 24. The user's mouth preferably can contact mouthpiece 3 internal to perimeter 26, such as internal thereto to minimize misdirected spit. The upper edge 22 preferably extends a distance above upper shoulder 27 of container 1 so as to provide a convenient sloping access through the mouthpiece 3 into the port 25 (such as a funnel or otherwise) and into the internal volume of a container 1 such as by placing mouth along slope 50. After spitting or otherwise directing fluid and/or other material into the mouthpiece 3 one can shut the lid 2, possibly with one hand, due to its relatively unique pivoting construction of the arm 16, 17 relative to the container 1 about pivot 12 for at least some embodiments to provide an enclosed volume. Pivot 12 can be constructed in various ways as would be understood by those of ordinary skill in the art. Raised thumb operator 99 could be located above arms 16, 17 at a rear 98 of lid 2 for at least some embodiments which could be utilized to assist in pivoting the lid 2 relative to the container intermediate closed and open configurations, possibly with one handed operation. Arms 16, 17 in this embodiment connect to and extend downwardly from lid 2.

Figure 3:
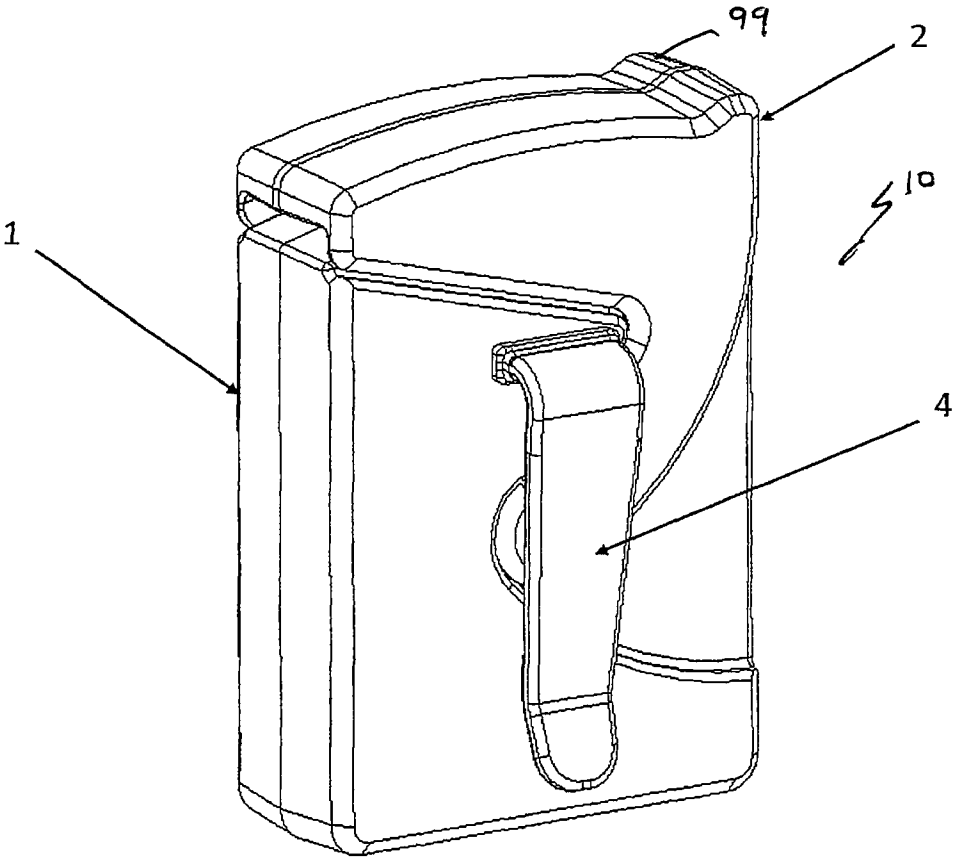
FIG. 3 illustrates a front perspective view of an alternative embodiment of the spittoon similar to that of FIGS. 1 and 2.

FIG. 3 shows an optional clip 4 which may be incorporated into some embodiments of the container 1 to permit carrying by clipping to a belt or other object. Clip 4 may extend above the pivot 12 for at least some embodiments.

Figure 4:
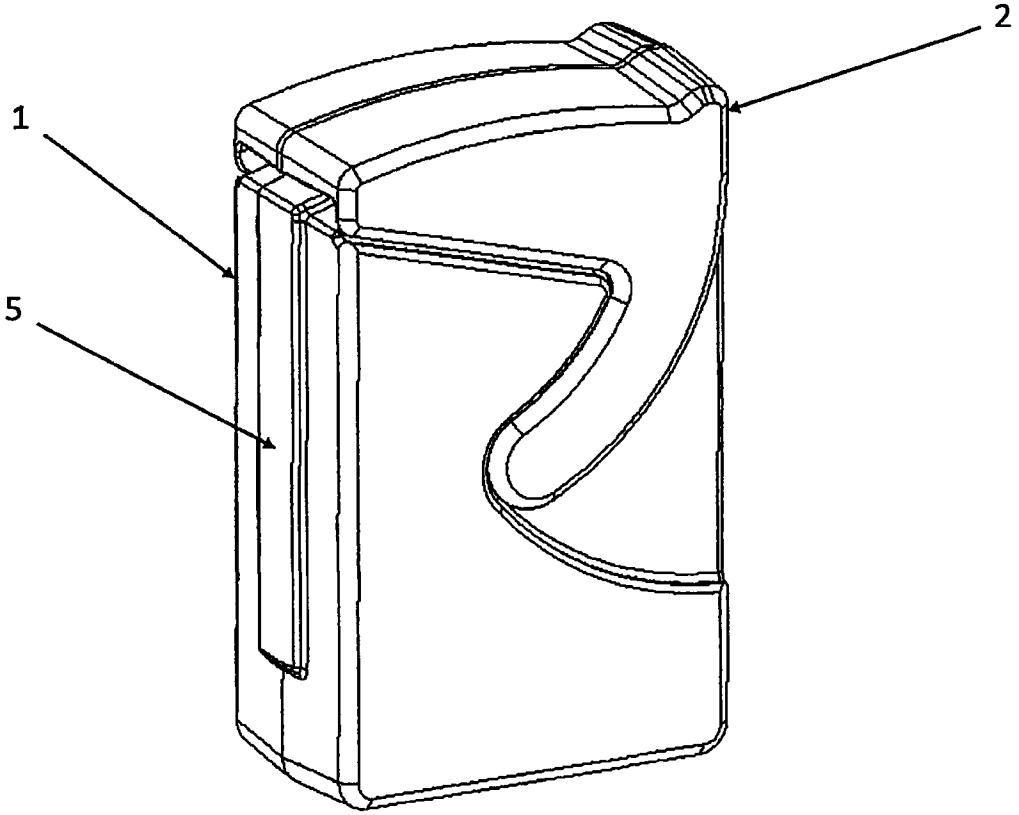
FIG. 4 illustrates a front perspective view of an alternative embodiment of the spittoon container similar to that of FIGS. 1-3 with and integrated site gauge.

FIG. 4 shows a transparent sight gauge 5 can be transparent while the majority of the container 1 can be opaque for at least some embodiments. This feature may be included in various embodiments of the spittoon 10.

Figure 5:
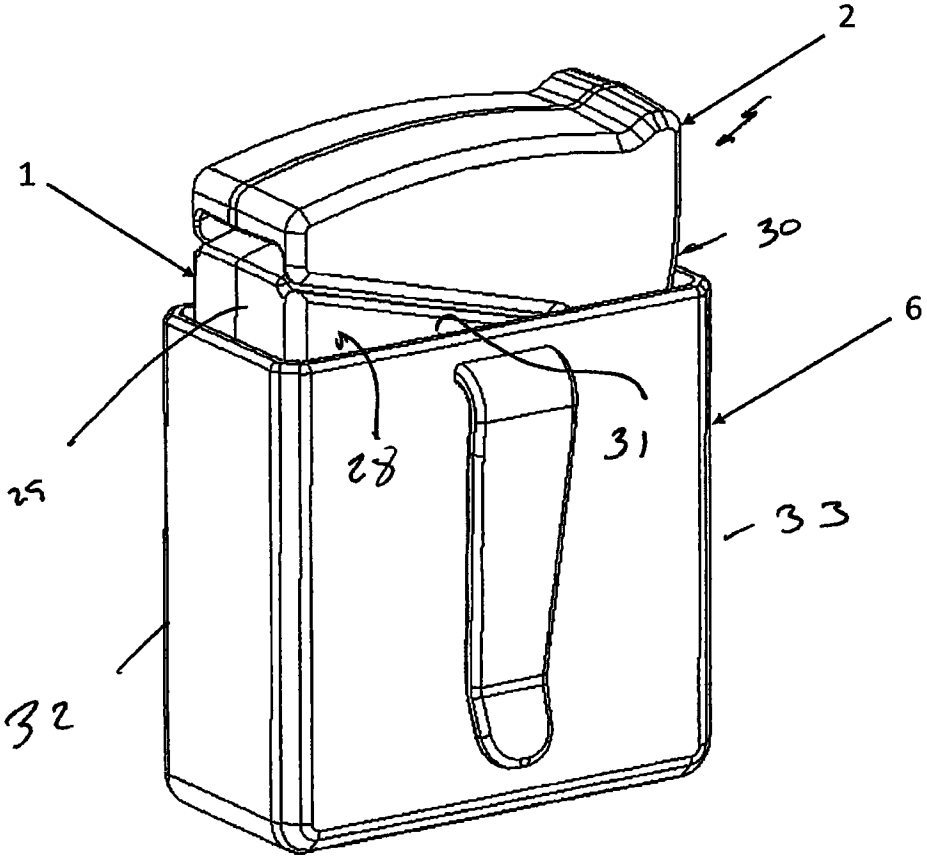
FIG. 5 illustrates a rear perspective view of the embodiment of FIG. 1-2 inserted into a holster.

Front 28 of spittoon 10 can be received against rear 31 of holster 6 and sides 29, 30 could be received internal to sides 32, 33 as shown in FIG. 5.

FIG. 6 shows the opposing sides 29, 30 of container 1 being received relative to front and back 32, 33 of the holster 6 with the rear 34 of the container 1 disposed towards the side 36 of the holster 6 possibly while a bottom 37 and side 36 of the container 1 define a slot 97 whereby the spittoon 10 may be removed from the holster 6 by contacting container 1 through the slot 97. Container 1 might be available to be accessed through the holster 6 as well as a portion of the back 34 so as to be able to reach down and grab the bottom 37 of the container 1 and pull the spittoon 10 upwardly or otherwise from the holster 6. With such a construction the rear 36 of the holster 6 may have a gap 38 beginning at bottom 39 of the holster 6 and extend upwardly towards upper edge 40 possibly in an expanding nature so as to make it easier to reinstall the container 1 into the holster 6 and/or extricate the container 1 from the holster 6 as would be understood by those of ordinary skill in the art.

Figure 7:
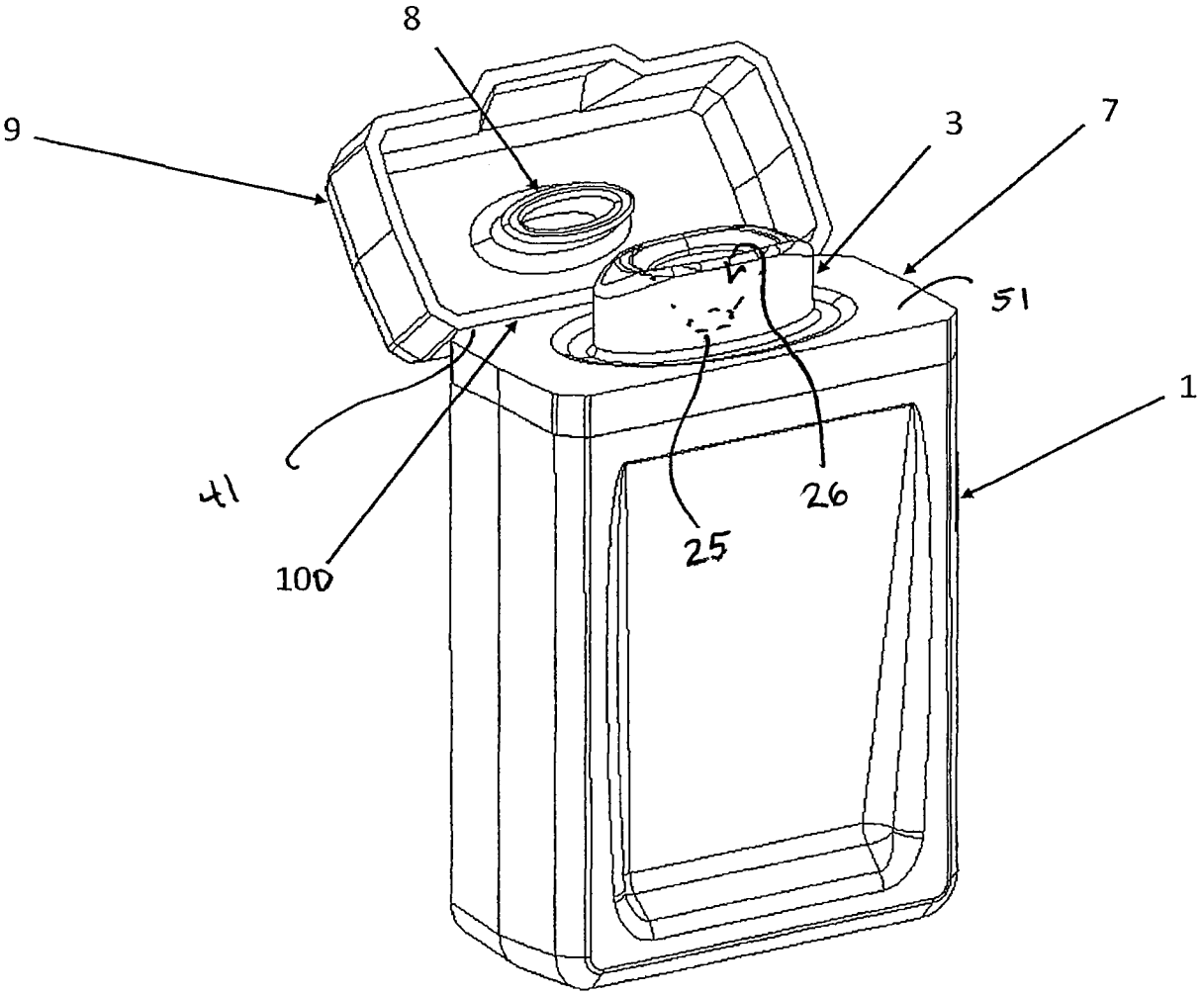
FIG. 7 is a front perspective view of an alternative preferred embodiment of the spittoon in an open configuration.
Figure 8:
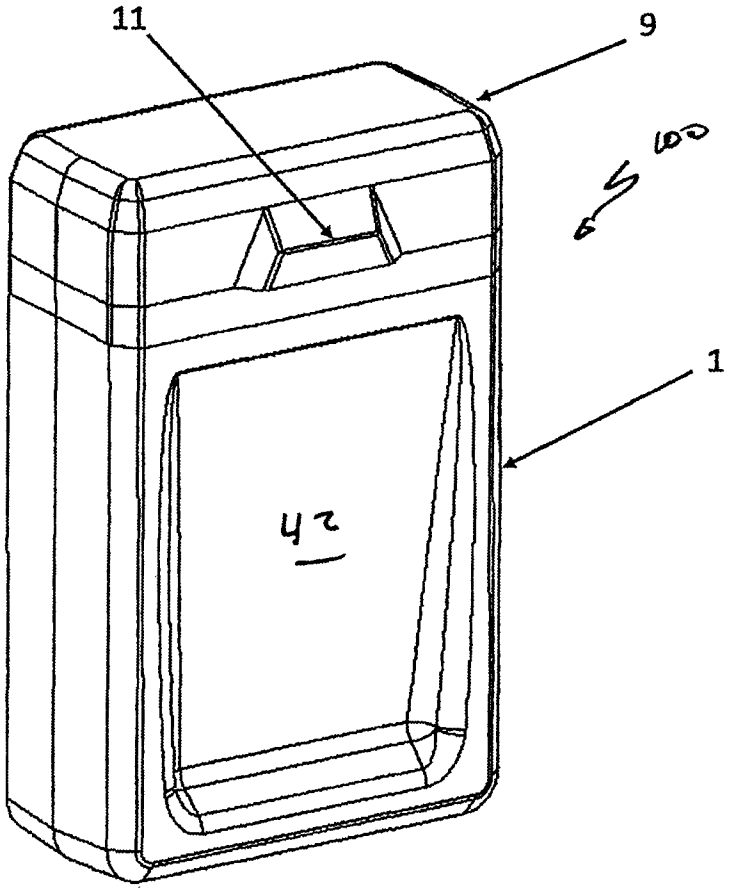
FIG. 8 is a front perspective view of the embodiment of FIG. 7 in a closed configuration.

FIG. 7 shows yet another embodiment which may be more affordable to manufacture than the various embodiments of FIGS. 1-6. Specifically, the spittoon 100 has a container 1 with a mouthpiece 3 extending above an upper surface 51 of cap 7 which could be an integrally manufactured cap 7. The cap 7 could be snapped on to the container 1 possibly with the mouthpiece 3 being a portion of the container 1 or being a portion of the cap 7. The lid 9 may have a seal 8 which cooperates with the mouthpiece 3 to be received at least partially internal to upper rim 26 so as to prevent fluid from passing from port 25 when the seal 8 is inserted into the mouthpiece 3 in a closed configuration such as shown in FIG. 8. Mouthpiece 3 may be constructed similarly or dissimilarly from the embodiment show in FIGS. 1-6.

FIG. 8 could have a port 25 sealed from spilling due to the closure of the lid 9 such as with tab 11 or otherwise. A living hinge 41 could be provided or other pivot capability of the lid 9 relative to the container 1. Panel 42 could be provided in various locations to receive indicia thereon such as trademarks and/or logos for sponsorship of manufacturers and/or co-branding and/or sponsorship of others such as for various manufacturers of tobacco products which could utilize the spittoon 10, 100 as promotional materials and/or for other information.

Containers 1 and/or lids 2 may be molded through various ways whether through injection molding, blow molding and/or other methodology. Plastics or other materials could be utilized for various embodiments. The seal 8 may be a different material than the lid 9 and/or container 1 so as to preferably contact against portions of the mouthpiece 3 internal to the upper ledge 26 to assist is sealing or otherwise. Halves 56, 57, if so constructed with halves, if not blow molded or otherwise constructed, could be molded in various ways and adhered together through various techniques as known in the art. Internal baffle members 58, 59 may downwardly extend from upper surface or shoulder 60 so as to assist in at least preventing spilling should the container 1 tip over on its side and possibly prevent or assist in preventing emptying if turned completely upside-down. The applicant is thus trying to for may embodiments provide a single use article so they will be discarded after use and then need another article. Connection of the two halves 56, 57 can be sonic welded, heat welded and/or connected with other techniques.

Figure 11:
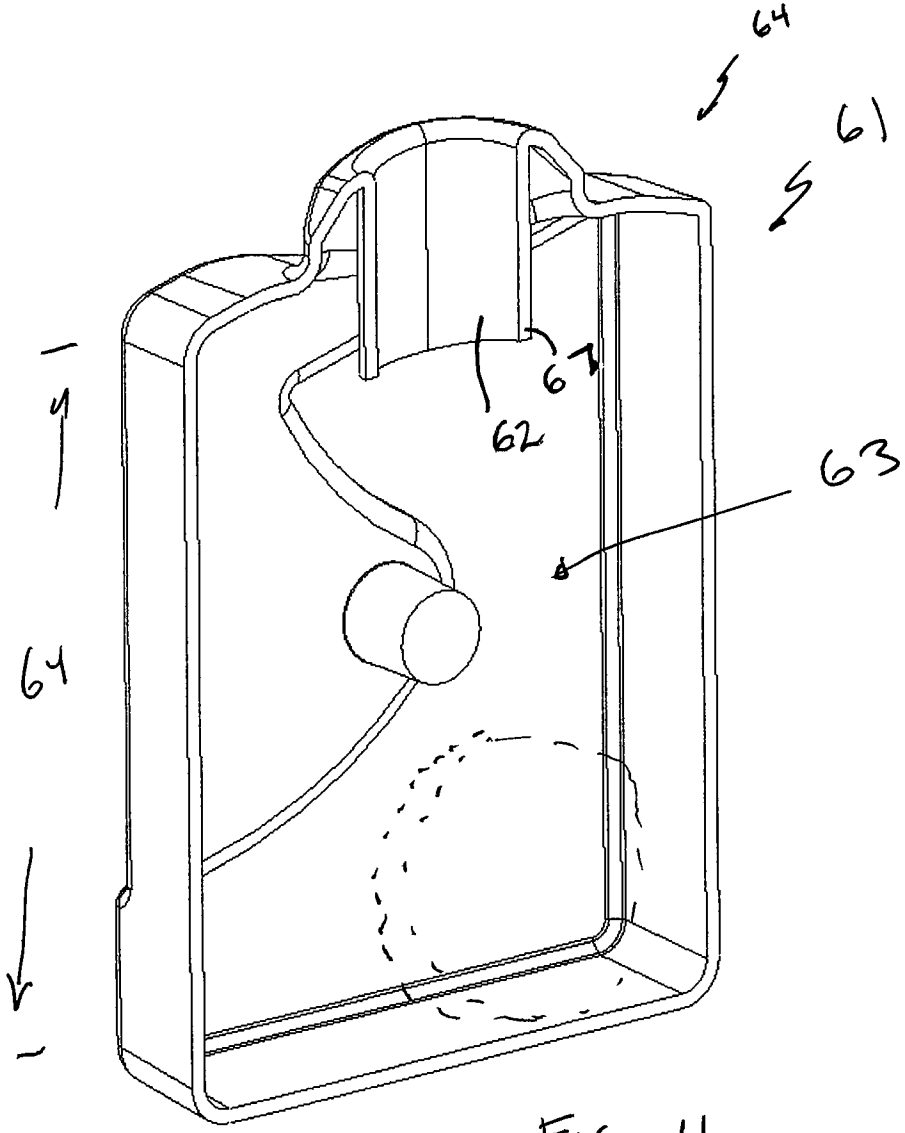
FIG. 11 is a perspective view of an alternatively preferred embodiment of half of the container of the present invention.
Figure 13:
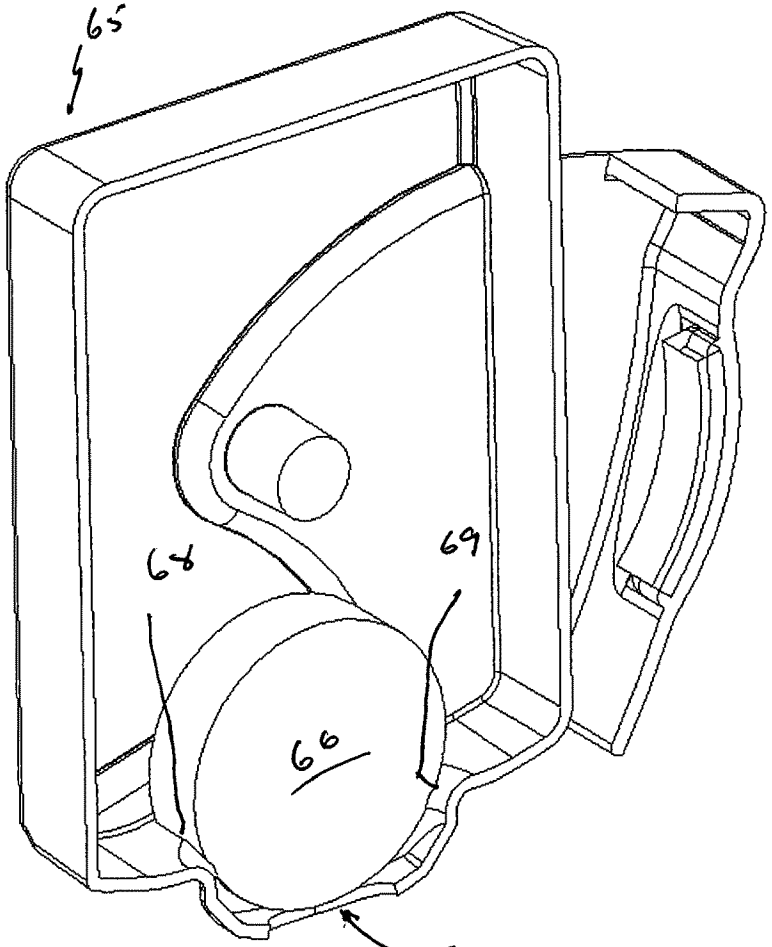
FIG. 13 is a perspective view of the embodiment shown in FIG. 12 in an upside-down position.

FIG. 11 shows an alternatively preferred embodiment of a half or other portion 61 with a port 62 which could be a funnel or other style opening which preferably extends downwardly into volume 63 (a portion of an enclosed volume 63 in the closed configuration) at least a sufficient distance so that if the container 64 which would have a similar construction half 61 connected thereto or turned upside-down the extension 67 would at least assist in reducing the likelihood of spilling and/or prevent emptying depending on the length of the extension 62 relative to container 64 height. Extension 67 preferably terminates pivot 12 for at least some embodiments.

Figure 12:
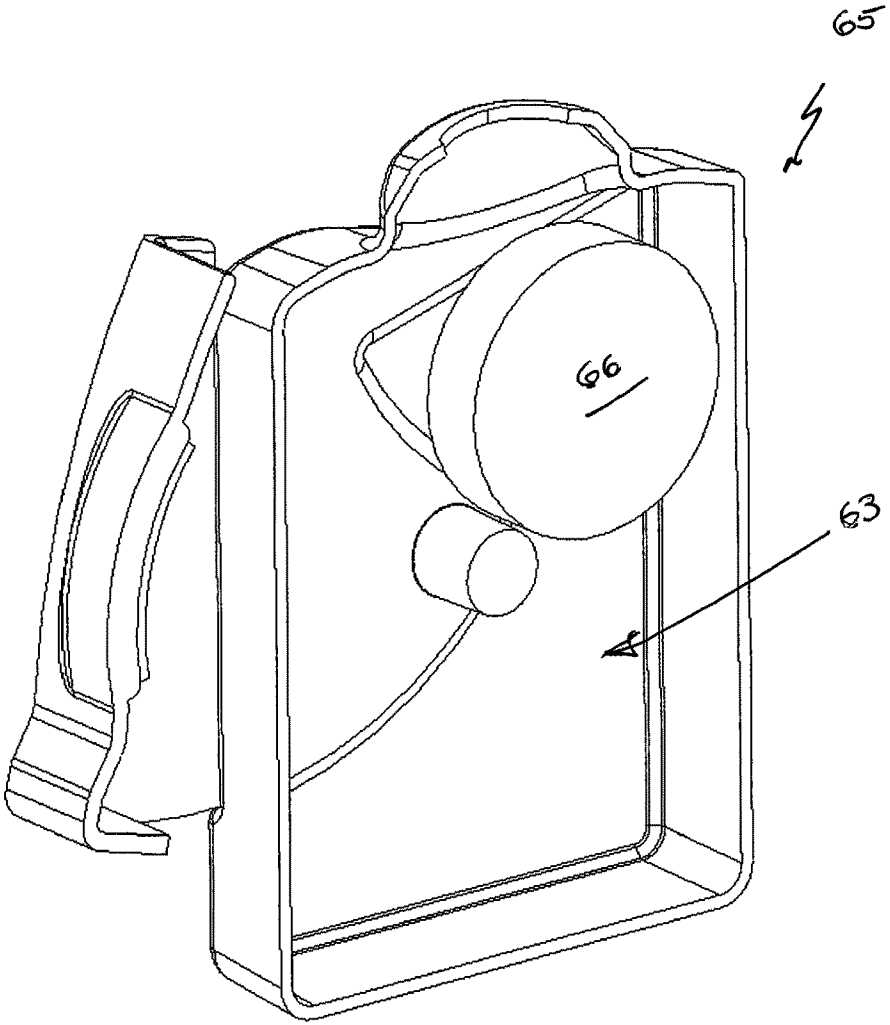
FIG. 12 is a perspective view of an alternatively preferred embodiment of half of the container as shown in FIGS. 1-6.

FIG. 12 shows yet another half 65 which shows an internal member 66 which could also be a sponge like material for various embodiments which may either be a stationary sponge and so utilized and/or a movable sponge internal to the volume 63 and/or other stop. The sponge might soak up and tend not to disgorge its contents from the container if constructed like the half 65. Spittoon 10, 100 could then be discarded. Some embodiment may instead or also use a stop as an internal 66 so that when the bottle is turned upside-down the stop moves to prevent to potentially resist flow against shoulders 68, 69 to prevent flow out of the port 25 of the mouthpiece 3. Once again this would tend to make the spittoons 10, 100, etc. spill proof and/or single use.

Figure 10:
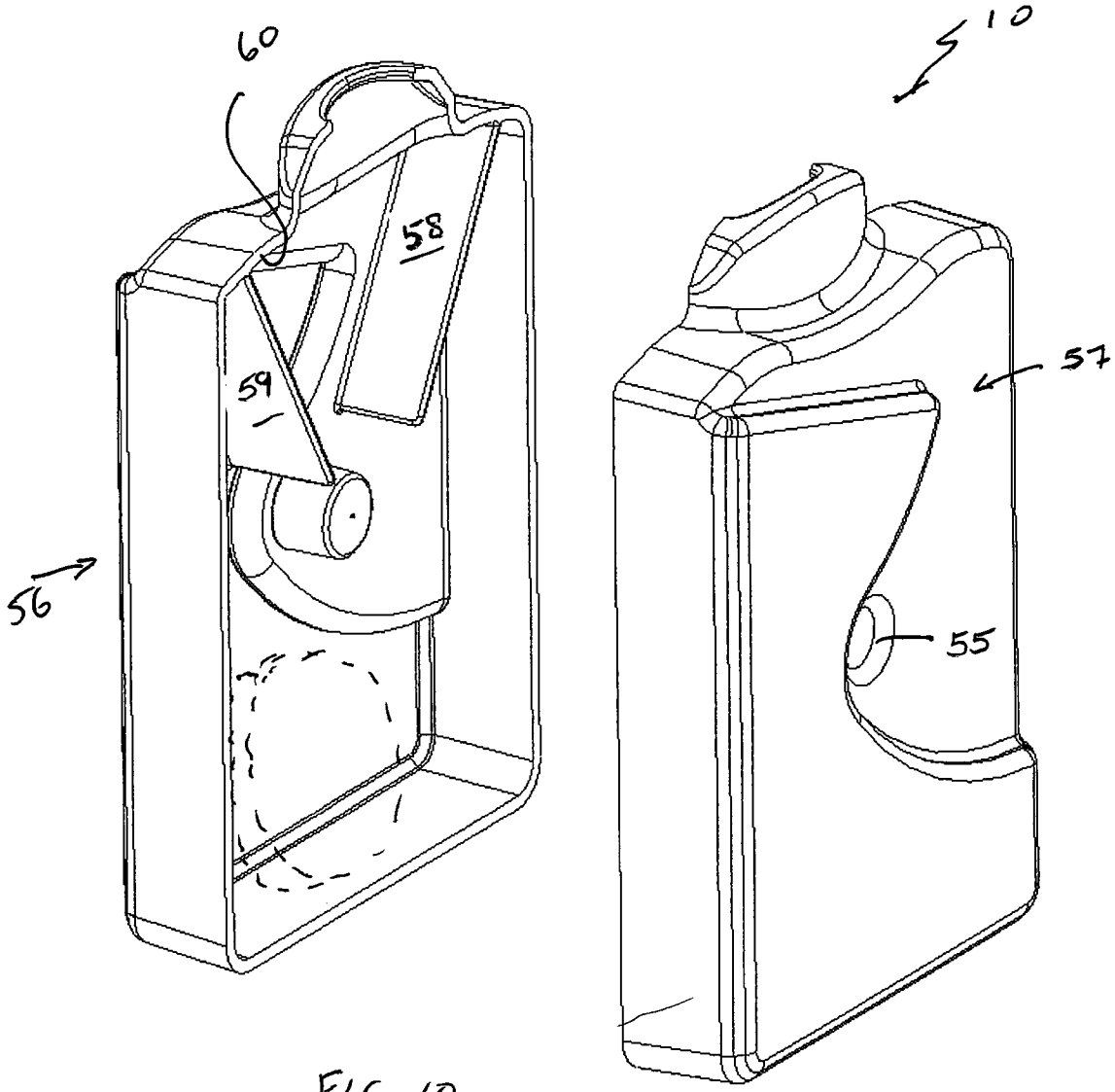
FIG. 10 is an exploded view of the container such as shown in FIGS. 1-6 in an exploded view.
Figure 14:
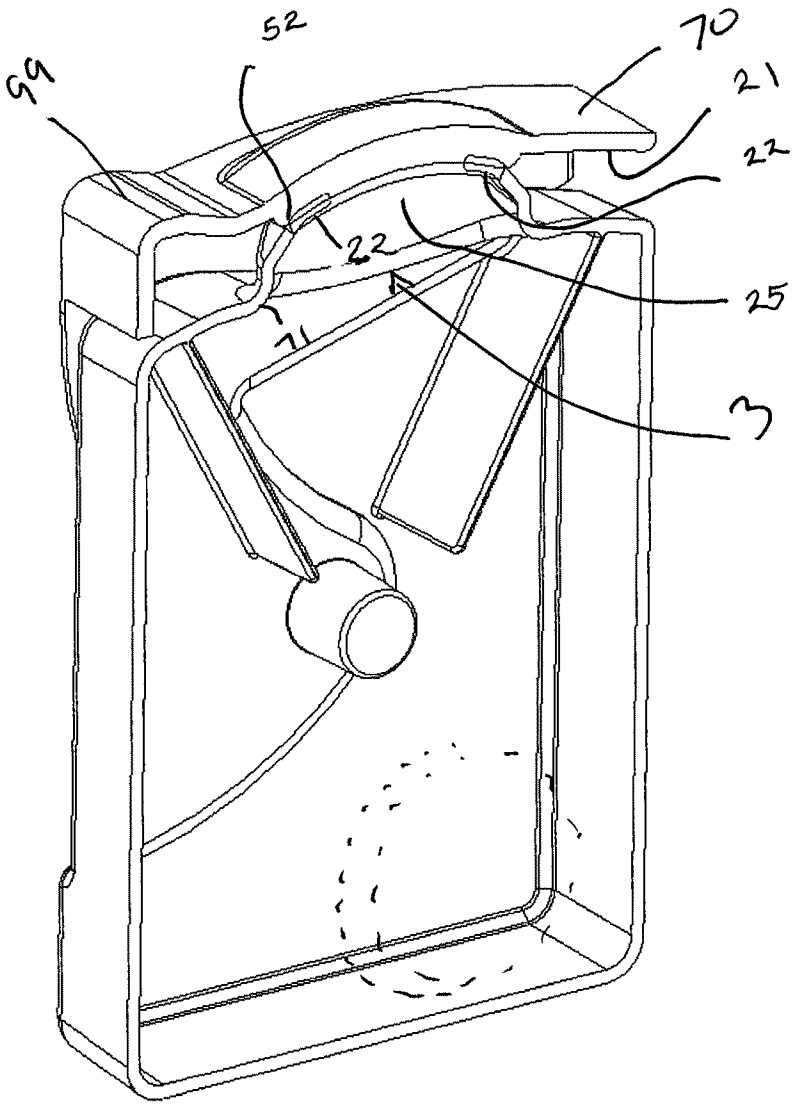
FIG. 14 is a perspective view of the embodiment of FIG. 10 with the lid in a closed configuration.

FIG. 14 shows a half somewhat similar to the half 56 shown in FIG. 10 with a half or cross section of the lid 70 shown with seal 52 sealing against upward surface 22 of the mouthpiece 3 above the port 25 both at or about the port 25 to preferably provide a leak-proof seal in the closed configuration. This could be accomplished in a number of ways whether it be with a resiliency of seal 52, close tolerances of the lower surface portion 21 relative to the upper surface 22 of the mouthpiece 3, slight deformation of the upper surface 22, or other portion of the mouthpiece 3 when closing. which could either be at the upper surface 22 and/or by downwardly directed force of the lid 2, or a larger portion of the mouthpiece 3 such as at elbows 71 and or other portion of the mouthpiece 3.

Numerous alterations to the structures herein disclosed will suggest themselves to those skilled in the art. However, it is to be understood that the present disclosure relates to the preferred embodiment of the invention for which is for purposes of illustration only and not to be construed as a limitation of the invention. All such modifications which do not depart from the spirit of the invention are intended to be included within the scope of the appending claims.

What is claimed is:

1. A portable spittoon comprising:

a container having opposing sides and a mouthpiece with a port therethrough at an upper portion of the container communicating with a volume of the container;

a lid connected to downwardly extending opposing arms, said arms extending external to and operably coupled to the sides along at respective pivots, a closed configuration whereby the lid at least assists in providing a seal with the mouthpiece to at least resist spilling of fluid from the volume internal to the container with the mouthpiece intermediate the downwardly extending arms providing an enclosed volume within the container; whereby the lid pivots from the closed configuration at the pivots out of sealing engagement with the mouthpiece to an open configuration permitting access to the port to receive material therein.

2. The portable spittoon of claim 1 wherein at least one of the sides has a first stop on an external surface of the at least one of the sides for the closed configuration contacting the at least one of the arms preventing further rotation.

3. The portable spittoon of claim 2 wherein both of the sides have the first stop, respectively.

4. The portable spittoon of claim 2 wherein at least one of the sides a second stop on an external surface of the at least one of the sides preventing further rotation in an open configuration.

5. The portable spittoon of claim 4 wherein both of the sides have the second stop, respectively.

6. The portable spittoon of claim 5 wherein the first and second stops define a cutout in the sides, respectively.

7. The portable spittoon of claim 1 wherein the lid has a lower surface portion, and the lower surface portion of lid contacts and seals against an upper surface of mouthpiece about the port in the closed configuration.

8. The portable spittoon of claim 1 wherein the lid has a lower surface portion and the lower surface of the lid at least one of (a) contacts an upper surface of mouthpiece in sealing arrangement, (b) has a resilient seal thereon, and (c) downwardly displaces the mouthpiece in sealing arrangement.

9. The portable spittoon of claim 1 wherein the arms connect at a rear end of the lid.

10. The portable spittoon of claim 9 further comprising a raised thumb operator located above the arms.

11. The portable spittoon of claim 1 wherein the mouthpiece has a ramp directed towards lid when in the closed configuration and when in the open configuration, and the ramp assists in receiving the lid into the closed configuration.

12. The portable spittoon of claim 1 wherein the mouthpiece has a funnel proceeding from an upper surface of the mouthpiece downwardly into the port narrowing intermediate an upper surface of the mouthpiece to the port internal to the mouthpiece.

13. The portable spittoon of claim 1 further comprising a belt clip operably coupled to a side of the container.

14. The portable spittoon of claim 13 further comprising a holster receiving the container at least partially therein, wherein the belt clip is connected to the holster and the holster has a slot beginning at bottom portion of the holster and extending along a side opposite the belt clip to an upper surface of the holster.

15. The portable spittoon of claim 1 wherein the arms have perpendicularly extending extensions at the pivots, respectively.

16. The portable spittoon of claim 1 further comprising at least one internal baffle in the container resisting at least spilling.

17. The portable spittoon of claim 16 wherein the at least one internal baffle further comprises baffle members downwardly extending into the enclosed volume relative to the mouthpiece.

18. The portable spittoon of claim 16 wherein the at least one internal baffle terminates above the pivots of the arms.

19. The portable spittoon of claim 1 further comprising at least one internal member in the volume resisting discharging fluid from the container.

20. The portable spittoon of claim 19 wherein the internal member is one of a sponge material and a mechanical stopper.

* * * * *